United States Patent [19]

Ohmori

[11] Patent Number: 4,647,029

[45] Date of Patent: Mar. 3, 1987

[54] PAPER SHEET FOLDING DEVICE

[75] Inventor: Masami Ohmori, Hadano, Japan

[73] Assignee: Duplo Seizo Kabushiki Kaisha, Komae, Japan

[21] Appl. No.: 787,647

[22] Filed: Oct. 16, 1985

[30] Foreign Application Priority Data

Jul. 9, 1985 [JP] Japan ..... 60-151147

[51] Int. Cl.[4] ..... B42C 1/00

[52] U.S. Cl. ..... 270/45; 493/421; 493/437

[58] Field of Search ..... 270/45–46; 493/405, 411, 413–415, 417, 419–421, 424, 437, 442, 454

[56] References Cited

U.S. PATENT DOCUMENTS 1,813,476 7/1931 Waterworth ..... 270/45

FOREIGN PATENT DOCUMENTS 1032472 11/1952 Fed. Rep. of Germany ..... 493/437
2152078 5/1972 Fed. Rep. of Germany ..... 493/454
2709567 3/1977 Fed. Rep. of Germany ..... 493/437

*Primary Examiner*—E. H. Eickholt
*Attorney, Agent, or Firm*—Pearne, Gordon, McCoy, & Granger

[57] ABSTRACT

A paper sheet folding apparatus includes three rotatably mounted folding rollers which cooperate in pairs to provide two folds in a single paper sheet or a packet of paper sheets. A first paper support member on one side of the rollers cooperates with a delivery roller to flex paper into one of the pairs of rollers to provide a first fold in the paper. A second paper support member on the opposite side of the rollers receives the folded paper and cooperates with the first pair of rollers to flex the paper into the second pair of rollers to provide a second fold in the paper. The second pair of rollers then discharges the paper from the apparatus.

16 Claims, 3 Drawing Figures

PAPER SHEET FOLDING DEVICE

BACKGROUND OF THE INVENTION AND PRIOR ART

The present invention relates to a paper sheet folding device and more particularly to such a device adapted to fold a packet of several paper sheets at one time.

A typical construction of such a paper sheet folding device of the prior art is disclosed, for example, by Japanese Utility Model Registration No. 1592186 (Utility Model Publication No. 59-29007). This device comprises a paper feeder mechanism, a folding plate provided with an adjustably movable stopper and a pair of folding rollers. The paper sheet is fed by the paper feeder mechanism to the folding plate in such manner that the forward end thereof comes in contact with the stopper of said folding plate to be flexed, then the flexed portion of the paper sheet is grasped between the folding rollers to fold the paper sheet.

The device of the prior art as has been described above cannot be used to fold a packet of paper sheets because its paper feeder mechanism is not adapted to feed the packet of several paper sheets at once and also because a folding deviation tends to occur between each pair of adjacent paper sheets within each packet when the latter is folded at once. This deviation occurs since a location along which each paper sheet is folded depends upon factors such as the degree of paper sheet flexure and the timing of the paper sheet being grasped by the folding rollers. Thus, this device is certainly suitable for continuously handling a plurality of paper sheets having the same size one by one, but inconvenient when it is desired to fold a packet of paper sheets at once into a predetermined size, as when several letter sheets are folded to be inserted into each envelope. Accordingly, it has been a usual practice to manually fold each packet of letter sheets for insertion into each envelope. However, such a manual operation is extremely troublesome and inconvenient in that the size of each sheet after being folded cannot be uniform within each packet.

SUMMARY OF THE INVENTION

It is an object of the present invention to overcome the above-mentioned disadvantages of the prior art by the provision of an improved paper sheet folding device permitting a packet of several paper sheets to be effectively folded at one time into a predetermined size.

To achieve the object as set forth above, the device constructed in accordance with the present invention comprises a support member, a pair of folding rollers, delivery means, and a member to drive the delivery means. The support member includes an element adapted to position a paper sheet or a packet of paper sheets along one end. The folding rollers are disposed so that they are closely adjacent to one side of the paper sheet or the packet of paper sheets at a position of the fold to be formed. The delivery means is disposed on the opposite side to the folding rollers, i.e., closely adjacent to the packet on the other side thereof so that said delivery means is movable towards the folding rollers. The driving member is adapted to drive the delivery means towards a position adjacent a line along which the pair of folding rollers come in contact with each other.

With the paper sheet folding device constructed in accordance with the present invention as briefly described above, the delivery means is actuated to forcibly flex a paper sheet or a packet of paper sheet towards the contact line of both folding rollers a portion of the paper sheet or packet thus flexed is grasped between the folding rollers so as to fold the paper sheet or the packet of paper sheets.

DESCRIPTION OF PREFERRED EMBODIMENT

Figure 1:
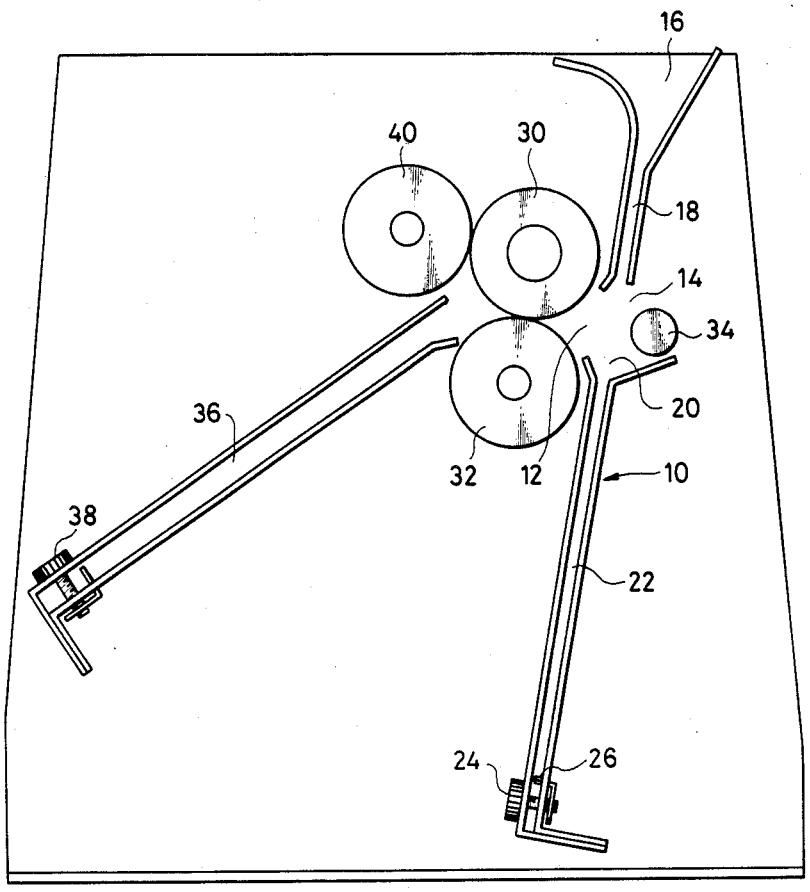
FIG. 1 is a schematic side view illustrating a central part of a triple-folder incorporated with one embodiment of the paper sheet folding apparatus according to the present invention.

Referring to FIG. 1, a support member or folding plate 10 is shown consisting of a pair of partitions which define therebetween a thin and planar space used to set a paper sheet or a packet of paper sheets. This support member 10 is divided into an upper portion and a lower portion at a position corresponding to a line along which the packet is folded in a manner as will be described later. The division is achieved by a pair of openings 12, 14 extending through the associated partitions and defined by respective pairs of edges extending perpendicularly to a plane of the drawing (longitudinally of folding rollers as will be described later). The partitions defining the upper portion of the support member 10 are upwardly flared to form an inlet 16 of paper sheets and downwardly converged to form an inclined planar region 18. The partitions defining the lower portion of the support member 10 are upwardly flared to form a guide region 20 and downwardly converged to form an inclined planar region 22 in alignment with said inclined planar region 18. The lower inclined planar region 22 is provided with a threaded stopper 24 which is adjustably and slidably fixed in a known manner at a desired position so that the forward end of the paper sheet or the packet bears against the stopper 24 and thereby the paper sheet or the packet is aligned and positioned. This stopper 24 includes a sheet detector element 26 using a microswitch or a photosensor.

Adjacent the opening 12, there are provided outside the support member 10 a pair of folding rollers, i.e., a driven roller 30 and a follower roller 32, which are mounted on axes extending longitudinally of the opening 12, respectively, and rotatably driven by drive means associated with said axes as will be described later. Adjacent the other opening 14, there is provided outside the support member 10 a small roller serving as delivery means 34 mounted on a free axis also extending longitudinally of the openings 12, 14 for movement towards the folding rollers 30, 32 and adapted to be driven by a driving device associated with said axis in the direction of said movement. On the side of the folding rollers 30, 32 opposite to the support member 10, there is provided a downwardly inclined folding plate 36 of the arrangement as previously mentioned in connection with the prior art and this folding plate 36 also includes a threaded stopper 38 which is adapted to be adjustably and slidably fixed at a desired position in a known manner. A pair of folding rollers associated with the folding plate 36 comprise said driven roller 30 and a follower roller 40 operatively associated therewith.

Figure 2:
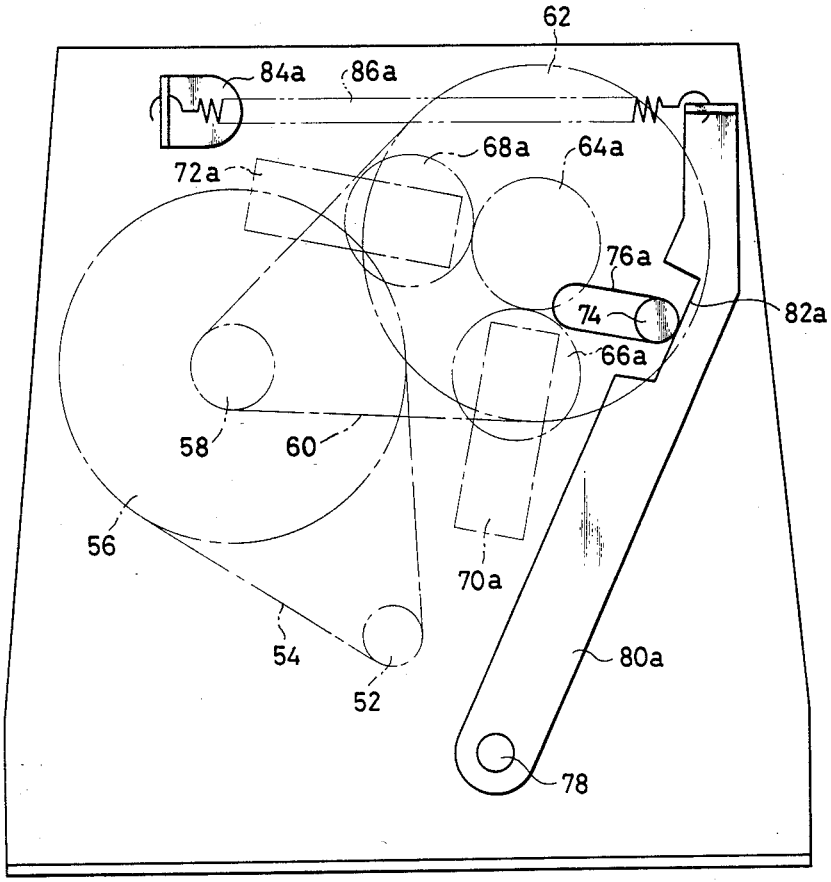
FIG. 2 is a schematic side view illustrating a drive mechanism of said triple-folder.

Referring to FIG. 2, an output shaft of an electric motor (not shown) carries a gear 52 coupled via a reduction gear train to a gear 64*a* which is integral with the driven roller 30. The reduction gear train comprises a large gear 56 coupled via a timing belt 54 to the output gear 52, a small gear 58 coaxial and integral with said large gear 56, and another large gear 62 which is coupled via another timing belt 60 to said small gear 58 and coaxially integral with said gear 64*a*. The gear 64*a* is engaged with a gear 66*a* integral with the follower roller 32, on one side, and with a gear 68*a* integral with the follower roller 40, on the other side. The gears 66*a*, 68*a* are biased by spring members 70*a*, 72*a*, respectively, towards the gear 64*a*. A slot 76*a* is formed in a housing wall adjacent the drive mechanism to support a shaft 74 for the delivery means or small roller 34. The slot 76*a* spans both openings 12, 14 of said support member 10 as seen in the side view, permitting an operative movement of the shaft 74 and, therefore, the small roller 34. Adjacent the slot 76*a*, there is provided a lever 80*a* adapted to rock around its lower shaft 78 which is integral with said lever 80*a*. The lever 80*a* is driven in a manner as will be described later so that said lever 80*a* may drive the shaft 74 for the small roller 34 using a cutaway 82*a* formed in its upper portion. The lever 80*a* is normally biased leftwards as seen in the drawing under an action of a spring 86*a* suspended between a spring hanger 84*a* mounted on the housing wall and an upper end of the lever 80*a*.

Figure 3:
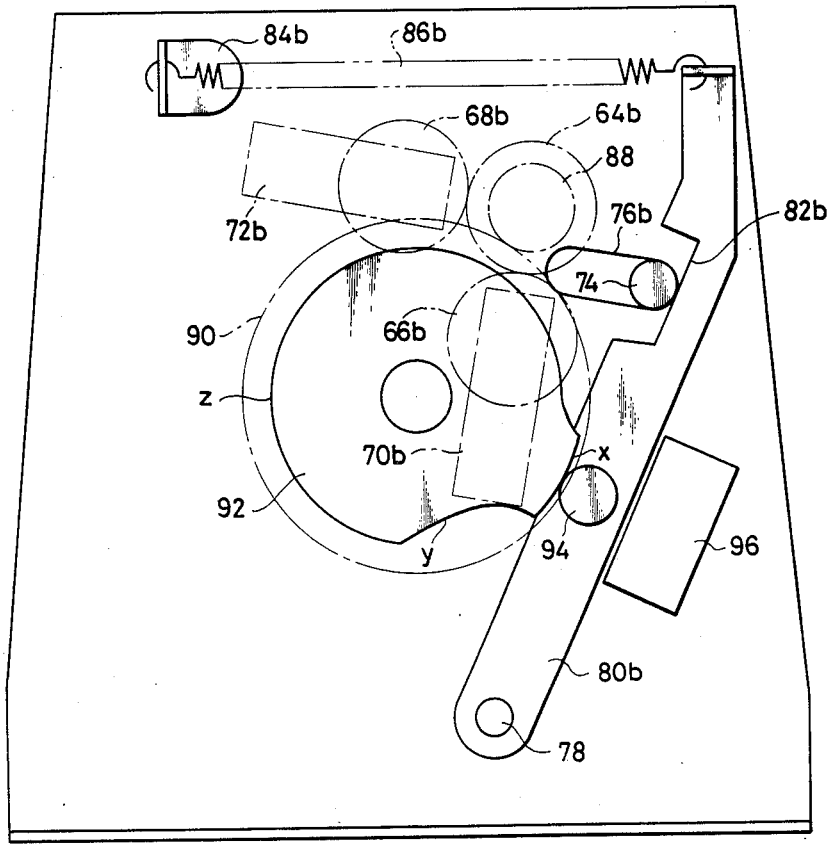
FIG. 3 is a schematic side view illustrating a drive mechanism as seen from the opposite side with respect to FIG. 2 but inverted for a better understanding.

Referring to FIG. 3, also on this side, a gear 64*b* integral with the driven roller 30 is engaged with gears 66*b*, 68*b* which are integral with the follower rollers 32, 40, respectively. The gears 66*b*, 68*b* are biased respectively by springs 70*b*, 72*b* into engagement with said gear 64*b* so as to assure a reliable operation of the folder. A slot 76*b* is formed in the housing wall to support the shaft 74 for the small roller 34. A lever 80*b* is provided adjacent this slot 76*b*. The lever 80*b* is adapted to rock around an integral lower shaft 78. The lever 80*b* also includes a cutaway 82*b* adapted to bear against the shaft 74 under a biasing effect of a spring 86*b* suspended between a spring hanger 84*b* mounted on the housing wall and an upper end of said lever 80*b*. In regard to these aspects, the arrangement of the drive mechanism on this side is in symmetrical relationship with that on the side as shown by FIG. 2.

A small gear 88 is coaxially integral with the gear 64*b* which is, in turn, integral with the driven roller 30. The gear 88 is engaged with a large gear 90 located adjacent the center on this side. A cam 92 is coaxially integral with the large gear 90 and engaged with a roller 94 projecting from the lever 80*b*. The cam 92 is shown to be in engagement with the roller 94 in the largest diameter region (x) of said cam, urging the lever 80*b* to its limit position on the right hand in the figure. Therefore, the shaft 74 and the small roller 34 are moved from the driven roller 30 under the influence of gravity of said small roller 34. When the cam 92 is engaged in its smallest diameter region (y) with the roller 94, the lever 80*b* is released and rotated leftwards in the drawing under the action of the spring 86*b* and the small roller 34 is urged by the shaft 74 against the driven roller 30. While the cam 92 is engaged in its intermediate diameter region (z) with the roller 94, the lever 80*b* is maintained at a position slightly rightward with respect to the position at which the lever 80*b* is maintained when the cam 92 is engaged in its smallest diameter region (y) with the roller 94. During engagement of the intermediate diameter region (z), the small roller 34 is maintained freely spaced from the driven roller 30 under the influence of gravity of said small roller 34.

On the opposite side of the lever 80*b* to the cam 92, there is provided a microswitch 96 including a switch pin (not shown) projecting towards the lever 80*b*. The drive motor (not shown) continues to operate independently of the position of the microswitch 96 so long as said paper sheet sensor element 26 senses the presence of paper sheets. While the element 26 senses the absence of paper sheets, the drive motor continues to operate so long as the switch pin of the microswitch is kept projecting and is deenergized upon retraction of said switch pin.

To perform actual operation of paper sheet folding with the triple folder constructed as has been described above, both the stoppers 24, 38 may be position-adjusted, if desired, according to the sheet size and the folding format in the initial state of the folder. (The respective figures correspond to this initial state) Thereafter, a single paper sheet or a packet of paper sheets may be introduced through the inlet 16 into the support member 10. When the paper sheets bear at their forward ends against the stopper 24 and are thereby properly positioned, the sheet sensor element 26 senses the presence of the paper sheets, actuating the drive motor. Simultaneously, the cam 92 is rotated counterclockwise in the drawing to release the lever 80*b* and, in consequence, said lever 80*b* and the lever 80*a* are rotated under the effect of the associated springs 86*b*, 86*a* so as to move the shaft 74 for the small roller 34 leftwards in the drawing along the slots 76*a*, 76*b*.

Such operation as mentioned above causes, in the central portion of the folder, the small roller 34 to move from the opening 14 to the opening 12 of the support member 10 to forcibly flex the paper sheet or the packet of paper sheets within the support member 10 from the rear side of the packet towards the pair of folding rollers 30, 32. As a result, a flexed portion of the paper sheet or the packet is grasped between the folding rollers 30, 32 and fed towards the folding plate 36 while the paper sheet or the packet is folded between said folding rollers. The upper and lower edges of the opening 12 serve as guide elements for effective flexure of the paper sheet or the packet. The small roller 34 continues to be rotated with the packet held between said small roller 34 and the roller 30 under the effect of the springs 86*a*, 86*b*, so long as the cam 92 is engaged at its smallest diameter region (y) with the roller 94.

The cam 92 continuously rotates to be engaged at its intermediate diameter region (z) with the roller 94 and during such transition the paper sheet or the packet of paper sheets has been folded on the side of the folding plate 36 in the manner as previously mentioned in connection with the paper sheet folding apparatus of prior art. More specifically, the paper sheet or the packet of paper sheets introduced into the folding plate 36 bears at its forward end corresponding to the fold which has been formed by the rollers 30, 32 against the stopper 38 provided within the folding plate 36. The rollers 30, 32 continue to feed the paper so as to flex the paper in the vicinity of the folding rollers 30, 40, and a flexed portion of the paper sheet or the packet of paper sheets is grasped between these folding rollers 30, 40 to form another fold. Finally, the paper sheet or the packet of paper sheets is folded in a desired threefold configuration and discharged out of the system. Even when the packet of paper sheets is being folded, the occurrence of the folding deviation is negligible, since, within the folding plate 36, the packet of paper sheets has already been folded on the precedent stage and the fold formed on this precedent stage constrains the packet against any significant relative displacement of the paper sheets.

The cam 92 is rotated as the above-mentioned folding process progresses, and comes in engagement at its largest diameter region (x) with the roller 94 again as the paper sheet or the packet of paper sheets is discharged out of the system. Thereupon, the lever **80*b* is rotated to the right and back to its initial position as shown in the drawing. In this position, the rear side of the lever 80*b* depresses the switch pin of the microswitch 96** to deenergize the drive motor.

Although the support member 10 as well as the folding plate 36 have been illustrated to include the respective stoppers 24, 38 in the above-mentioned, embodiment, the triple-folder exclusively used to fold paper sheet(s) of a fixed size into a predetermined form would require neither of these stoppers. The delivery means adapted to forcibly flex paper sheet(s) has been illustrated in the form of a small roller, but this delivery means may also be in the form of blade-like means having a thin edge along its forward end. Furthermore, the starting of the drive motor may be achieved not by the paper sheet sensor element 26 but by manipulating a separate switch button. In this case, the switch button continues to be depressed until rotation of the lever **80*b* releases the switch pin of the microswitch 96** to project and thereby automatically actuate the drive motor.

With the paper sheet folding apparatus according to the present invention, the delivery means forcibly flexes paper sheet(s) perpendicularly to the plane of paper sheet(s) to start the folding process, so that even a packet of several paper sheets can be correctly folded without any significant folding deviation.

I claim:

1. A paper sheet folding apparatus comprising three rotatably mounted folding rollers which cooperate to provide a first pair of rollers engaged along a first contact zone and a second pair of rollers engaged along a second contact zone, a first support member located adjacent a first side of said rollers for supporting paper to be folded, a second support member located adjacent an opposite second side of said rollers for supporting folded paper received from said first support member, delivery means located adjacent said first support member and drive means for rotationally driving said rollers and operating said delivery means, said first support member including first plate means for supporting paper to be folded, said first plate means including a longitudinally extending opening adjacent said first contact zone and having paper supported by said first plate means extending across said opening, said delivery means being operable to forcibly flex said paper through said opening towards said first contact zone and to cause a flexed portion of the paper to be grasped and the paper to be pulled between said first pair of rollers to provide a first fold in the paper, said second support member including second plate means for supporting folded paper as it passes between said first pair of rollers, said second plate means cooperating with said first pair of rollers to flex the paper toward said second contact zone and to cause a flexed portion of the paper to be grasped and the paper to be pulled between said second pair of rollers to provide a second fold in the paper.

2. An apparatus as set forth in claim 1, wherein said paper is grasped by said second pair of rollers before the paper is released by said first pair of rollers.

3. An apparatus as set forth in claim 2, wherein said second pair of rollers discharges said folded paper from the apparatus.

4. An apparatus as set forth in claim 2, wherein said first plate means include guide means extending along said opening to align the flexed portion of the paper with the first contact zone.

5. An apparatus as set forth in claim 4, wherein said first and second plate means respectively comprise first and second pairs of spaced plate members and said paper is supported between said spaced plate members.

6. An apparatus as set forth in claim 5, wherein said opening extends through said first plate members and said guide means comprise opposed edges of the one of said first plate members closest to said first contact zone.

7. An apparatus as set forth in claim 2, wherein said drive means includes a cam to operate said delivery means to flex the paper to provide said first fold and to disengage said delivery means after the first fold is completed.

8. An apparatus as set forth in claim 1, wherein said delivery means comprise a rotatable roller adapted to be biased against said paper to forcibly flex the paper through said opening.

9. An apparatus as set forth in claim 1, wherein said first plate means include first stop means for engaging the paper and causing paper supported by the first plate means to extend across said opening.

10. An apparatus as set forth in claim 9, wherein said second plate means include second stop means for engaging the paper and causing paper supported by the second plate means to be flexed by said first pair of rollers toward said second contact zone.

11. An apparatus as set forth in claim 10, wherein said stop means are adjustable to enable folding of paper of different sizes.

12. An apparatus as set forth in claim 1, wherein said paper comprises a packet of paper sheets and said first fold tends to constrain relative displacement of paper sheets of the packet while the packet is supported by said second plate means.

13. An apparatus as set forth in claim 1, wherein said first plate means includes a paper sheet sensor element.

14. An apparatus as set forth in claim 2, wherein said folding rollers are provided by first, second, and third rollers, said first and second rollers cooperating to provide said first pair of rollers and said third and second rollers cooperating to provide said second pair of rollers.

15. An apparatus as set forth in claim 14, wherein said first and second plate means respectively support said paper in substantially planar orientation with the width of the paper extending longitudinally along said rollers, said delivery means operating to flex said paper through said opening in a substantially perpendicular direction relative to the plane of the paper.

16. An apparatus as set forth in claim 15, wherein said second plate means includes an inlet for receiving said folded paper as it passes through said first pair of rollers and said inlet is located adjacent said second contact zone.

* * * * *